US005707208A

United States Patent [19]

Kreitmeier

[11] Patent Number: 5,707,208

[45] Date of Patent: Jan. 13, 1998

[54] DIFFUSOR FOR A TURBO-MACHINE WITH OUTWARDLY CURVED GUIDE PLATE

[75] Inventor: Franz Kreitmeier, Baden, Switzerland

[73] Assignee: Asea Brown Boveri AG, Baden, Switzerland

[21] Appl. No.: 707,072

[22] Filed: Sep. 3, 1996

Related U.S. Application Data

[63] Continuation of Ser. No. 473,938, Jun. 7, 1995.

[30] Foreign Application Priority Data

Jun. 29, 1994 [DE] Germany ..... 44 22 700.0

[51] Int. Cl.[6] ..... F01D 1/02

[52] U.S. Cl. ..... 415/211.2; 415/207

[58] Field of Search ..... 415/211.2, 225, 415/207

[56] References Cited

U.S. PATENT DOCUMENTS

| | | | |
|---|---|---|---|
| 1,302,282 | 4/1919 | Baumann | 415/211.2 |
| 3,400,911 | 9/1968 | Kojima | 415/211.2 |
| 3,552,877 | 1/1971 | Christ et al. | 415/211.2 |
| 4,013,378 | 3/1977 | Herzog | 415/211.2 |
| 4,315,715 | 2/1982 | Nishiguchi et al. | 415/211.2 |
| 4,391,564 | 7/1983 | Garkusha et al. | 415/211.2 |
| 5,203,674 | 4/1993 | Vinciguerra | 415/211.2 |
| 5,338,155 | 8/1994 | Kreitmeier | 415/211.2 |
| 5,362,203 | 11/1994 | Brasz | 415/211.2 |
| 5,588,799 | 12/1996 | Kreitmeier | 415/211.2 |

FOREIGN PATENT DOCUMENTS

| | | | |
|---|---|---|---|
| 265633 B1 | 5/1995 | European Pat. Off. . | |
| 834474 | 4/1952 | Germany | 415/211.2 |
| 178706 | 7/1989 | Japan | 415/211.2 |

*Primary Examiner*—John T. Kwon

*Attorney, Agent, or Firm*—Oblon, Spivak, McClelland, Maier & Neustadt, P.C.

[57] ABSTRACT

In a diffusor for an axial-flow steam turbine with an axial/radial diffusor, the kind angles Of the diffusor inlet both at the hub and at the cylinder of the turbo-machine are determined solely for the purpose of equalizing the total pressure profile over the channel height at the outlet of the last blade row. The diffusor is subdivided from the inlet to the outlet into an inner and an outer channel by a radially outward-curved guide plate. Within the deceleration zone of the diffusor, radial-flow flow ribs are arranged in the outer channel and diagonal-flow flow ribs are arranged in the inner channel for canceling the rotation of the rotational flow.

1 Claim, 3 Drawing Sheets

DIFFUSOR FOR A TURBO-MACHINE WITH OUTWARDLY CURVED GUIDE PLATE

This is a Continuation of application Ser. No. 08/473,938 filed on Jun. 7, 1995.

BACKGROUND OF THE INVENTION

1. Field of the Invention

The invention relates to a diffusor for an axial-flow turbo-machine, in which the kink angles of the diffusor inlet both at the hub and at the cylinder of the turbo-machine are determined solely for the purpose of equalizing the total pressure profile over the channel height at the outlet of the last blade row, means are provided for canceling the rotation of the rotational flow, in the form of flow ribs within the deceleration zone of the diffusor, and at least one flow-guiding guide plate is provided for subdividing the diffusor.

2. Discussion of the Background

Diffusors of this type for turbo-machines are known from EP-B-265 633. In order to meet the requirement for the best possible pressure recovery and nonrotational diffusor flow-off under a full load and a part load, a straightening cascade extending over the entire height of the channel through which the flow passes is provided within the diffusor. These means for canceling rotation are cylindrical flow ribs arranged uniformly over the circumference and having thick straight profiles which are designed in light of the knowledge of turbo-machine building and which are to be as insensitive as possible to an oblique onflow. The flow-facing front edge of these ribs is located relatively far behind the outlet edge of the last moving blades in order to prevent any excitation of the last blade row due to the pressure field of the ribs. This distance is calculated so that the front edge of the ribs is located in a plane in which a diffusor surface ratio of preferably three prevails. This first diffusion zone between the blading and the flow ribs is therefore to remain Undisturbed as a result of complete rotational symmetry. That no interference effects are to be expected between the ribs and blading is attributable to the fact that the ribs take effect only in a plane in which a relatively low velocity level already prevails.

Since, in the case of conventional highly loaded bladings of turbines, their opening angle far exceeds that of a good diffusor, in order to assist the flow the known diffusor is subdivided in the radial direction into a plurality of part diffusors by means of flow-guiding guide rings. These guide rings extend from a plane directly at the outlet of the blading to a plane in which a diffusion ratio of three is obtained, that is to say over the entire first diffusion zone. For reasons of vibration, these guide rings are preferably designed to be in one part. This leads to a design without a parting plane, which is disadvantageous for assembly reasons. Furthermore, in the case of large machines, the guide rings result in large diameters, so that transport problems cam arise.

A second diffusion zone extends from the front edge of the thick flow ribs as far as the largest profile thickness of the ribs. In this second zone, the cancellation of rotation of the flow is for the most part to be carried out largely without any deceleration. In a third downstream diffusion zone in the form of a straight diffusor, a further deceleration of the flow, virtually nonrotational at that moment, takes place.

All these measures are intended to achieve not only a maximum pressure recovery, particularly under part load, but also a reduction in the overall length of the plant.

In conventional gas turbines, the flow reaches the diffusor under no load at a velocity ratio $c_t/c_n$ of approximately 1.2, $c_t$ signifying the tangential velocity and $c_n$ the axial velocity of the medium. This oblique onflow leads to a decrease in the pressure recovery $C_p$.

In other machine types such as, for example, steam turbines, it is possible that the volume flow is reduced to 40% and therefore $c_t/c_n$ ratios up to 3 occur. In such machine types, a fixed diffusor geometry is inappropriate, since the pressure recovery could even become negative. This applies even when the ratio of spacing to chord of the flow ribs amounts to 0.5. Flow ribs with spacing/chord ratios of approximately 1, which would occur under full load, that is to say $c_t/c_n$=approx. 0, specifically a somewhat higher pressure recovery, cannot be used at all in such machines.

The pronounced decrease in the pressure recovery is attributable to the fact that, at the extreme ratios mentioned, a strong vortex forms between the outlet moving blades and flow ribs. The vortex is limited by the flow ribs on which the tangential component of the velocity is dissipated. If solid particles, for example water droplets in steam turbines, are carried along on the backflow which is established, an acute risk of foot erosion on the blades of the last moving-blade row can arise.

SUMMARY OF THE INVENTION

On the basis of 3D optimization by means of Navier-Stokes computing methods, an object on which the invention is based, in a diffusor of the initially mentioned type, is to achieve the physically highest possible pressure recovery in the case of a non-rotational flow-off at a predetermined diffusor surface area ratio, by which is meant the ratio of the flow cross sections at the outlet to the inlet of the diffusor.

This is achieved, according to the invention, by providing the diffusor channel with an axial inlet and a radial outlet, the diffusor channel being subdivided into an inner and an outer channel by means of a radially outward-curved guide plate. Radial-flow ribs are arranged in the outer channel of the diffusor and diagonal-flow ribs are arranged in the inner channel.

Although axial/radial diffusors, in which the kind angle idea is implemented, are already known from EP-A 581,978, these are nevertheless multi-zone diffusors of gas turbines, such as are shown in FIG. 4 thereof. Here, a first single-channel diffusion zone has a bell shape. A second diffusion zone which is subdivided into three part diffusors by means of two guide rings, opens into a third diffusion zone which deflects sharply with only slight deceleration. This sharp deflection is greatly assisted by the arrangement of the guide rings which are continued into the diffusion zone. This measure brings about a favorable increase in the mean radius of curvature of the third diffusion zone in relation to the channel height.

Furthermore, in axial-flow low-pressure parts of steam turbines with radial exhaust steam, it is already known to assist the diffusor flow by means of radially outward-curved guide plates. In such a machine, illustrated in FIG. 1 and described later, the two guide plates are staggered in the axial direction for reasons of construction, in such a way that they take effect in different planes. Disadvantages of this solution include the only local effect of these deflection aids and the many fastening struts which are necessary in order to support the guide plates. They Considerably impair the diffusor flow. For this reason, at the present time diffusors are usually designed without any augmentation. This results in high flow losses.

The present invention, proceeding from a plant in which a highly divergent flow is present at the outlet of a blading, with counter-rotation at the hub, corotation at the cylinder and substantially higher flow energy in the radially outer zone, has the advantage of successfully using, for the first time, the king angle idea in order to achieve the least possible total pressure non-homogeneity over the blade height in a two-channel diffusor. The deliberate arrangement of a curved continuous guide plate for assisting the diffusor flow during the meridional deflection, and of a flow-oriented additional guide row in the two part channels in the form of profiled ribs, ensures a low-loss conversion of the rotational flow energy into pressure energy. The flow ribs also provide the mechanical support of the guide plate, with the result that the previous high-loss struts can be dispensed with.

If the guide plate having the inner and outer flow ribs and the associated inner and outer diffusor rings are designed as self-supporting half-shells with a horizontal parting plane, the mechanical integrity of the guide plate achieved thereby makes it easier to carry out a simple mounting/demounting of the diffusor and to have access to the blading.

It is expedient if, in order to largely avoid interference with the last moving-blade row of the blading, in the inner channel the ratio of the rib distance "a" from the outlet of the blading to the rib circumferential spacing "t" amounts to at least 0.5. Moreover, this measure results in a complete utilization of the work capacity of the flow medium.

If the ratio of rib chord "s" to rib spacing "t" amounts to at least 1, this ensures that the sensitive diffusor flow is deflected into the non-rotational flow-off direction without any breakaway, and that a contribution to the desired deceleration is made.

Insofar as the ratio of the largest profile thickness "$d_{max}$" of the flow ribs to rib chord "s" amounts at most to 0.15 and is largely constant over the rib height, excess velocities, local Mach-number problems and varying displacement effects are thereby minimized, It is appropriate, moreover, if the front edges of the ribs are oriented over the rib height in such a way that they are intersected perpendicularly by the flow lines. This ensures, together with the measure $d_{max}/s$=constant, that the flow is not forced off outward and a breakaway forms.

Advantageously, the curvature of the median line of the ribs is selected with a view to a jolt-free inlet and an axial flow-off. This guarantees the desired high pressure recovery and some insensitivity under part load.

In the case of a horizontal parting plane in the diffusion zone, an even number of ribs is provided, ribs being arranged in the vertical plane, but not in the horizontal plane.

It is expedient if the radial flow ribs are provided at their two ends with foot plates, by means of which they are embedded in annular turned recesses in the outer diffuser ring and in the guide plate. It is particularly beneficial if the arcuate circumferential surfaces of both the inner and the outer plate sides are provided with grooves into which correspondingly dimensioned prongs of the foot plates engage. In addition to the highly defined guidance of the flow ribs, tensile forces can also thereby be introduced into the guide-blade carrier via the flow ribs. In the event of a possible erosive attack on the flow ribs, these can be exchanged in the simplest possible way.

BRIEF DESCRIPTION OF THE DRAWINGS

A more complete appreciation of the invention and many of the attendant advantages thereof will be readily obtained as the same becomes better understood by reference to the following detailed description of an exemplary embodiment when considered in connection with the accompanying drawings, wherein.

DESCRIPTION OF THE PREFERRED EMBODIMENTS

Figure 1:
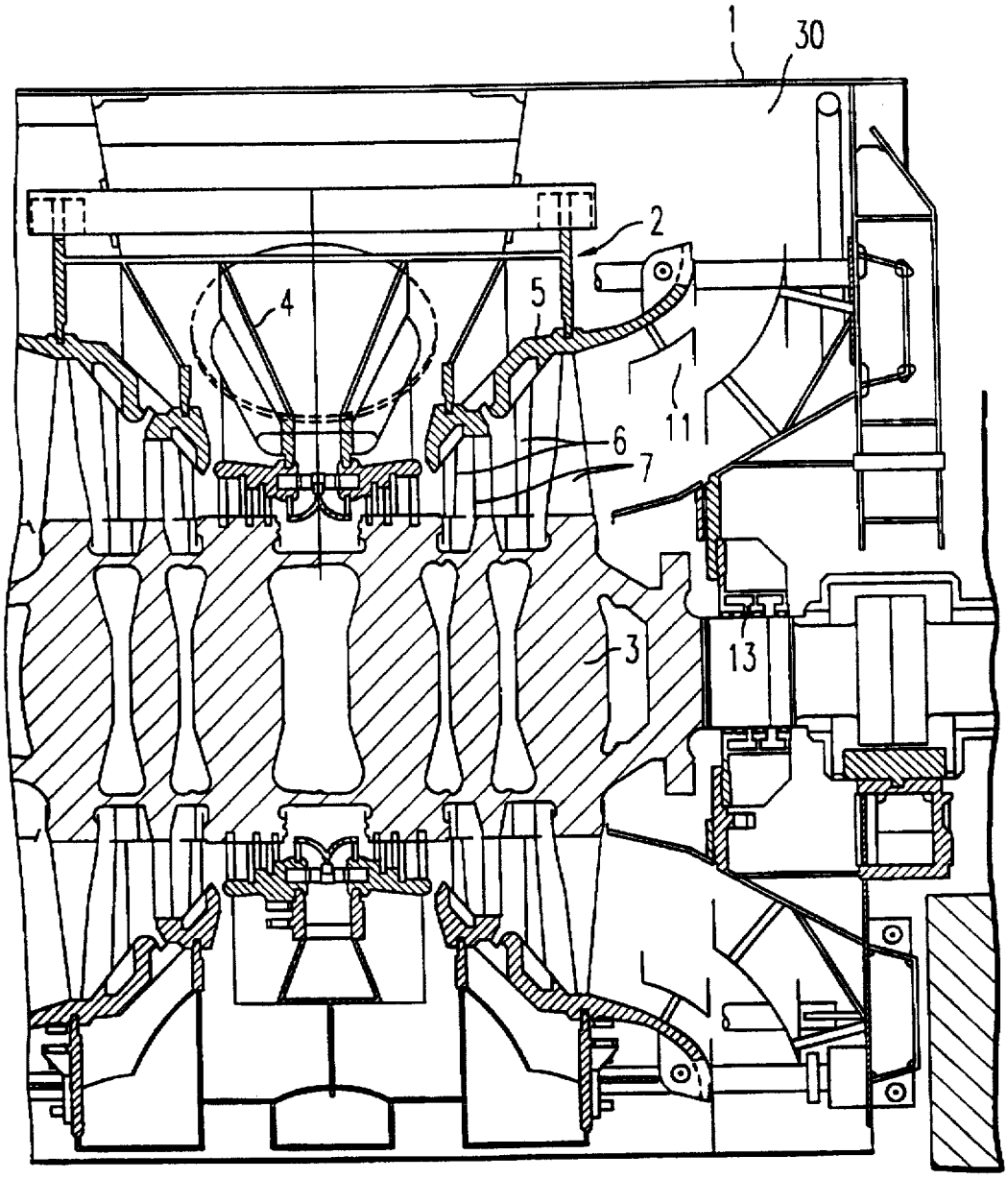
FIG. 1 PRIOR ART
FIG. 1 shows a double-flow low-pressure part turbine in axial section with a conventional diffusor.
Figure 3:
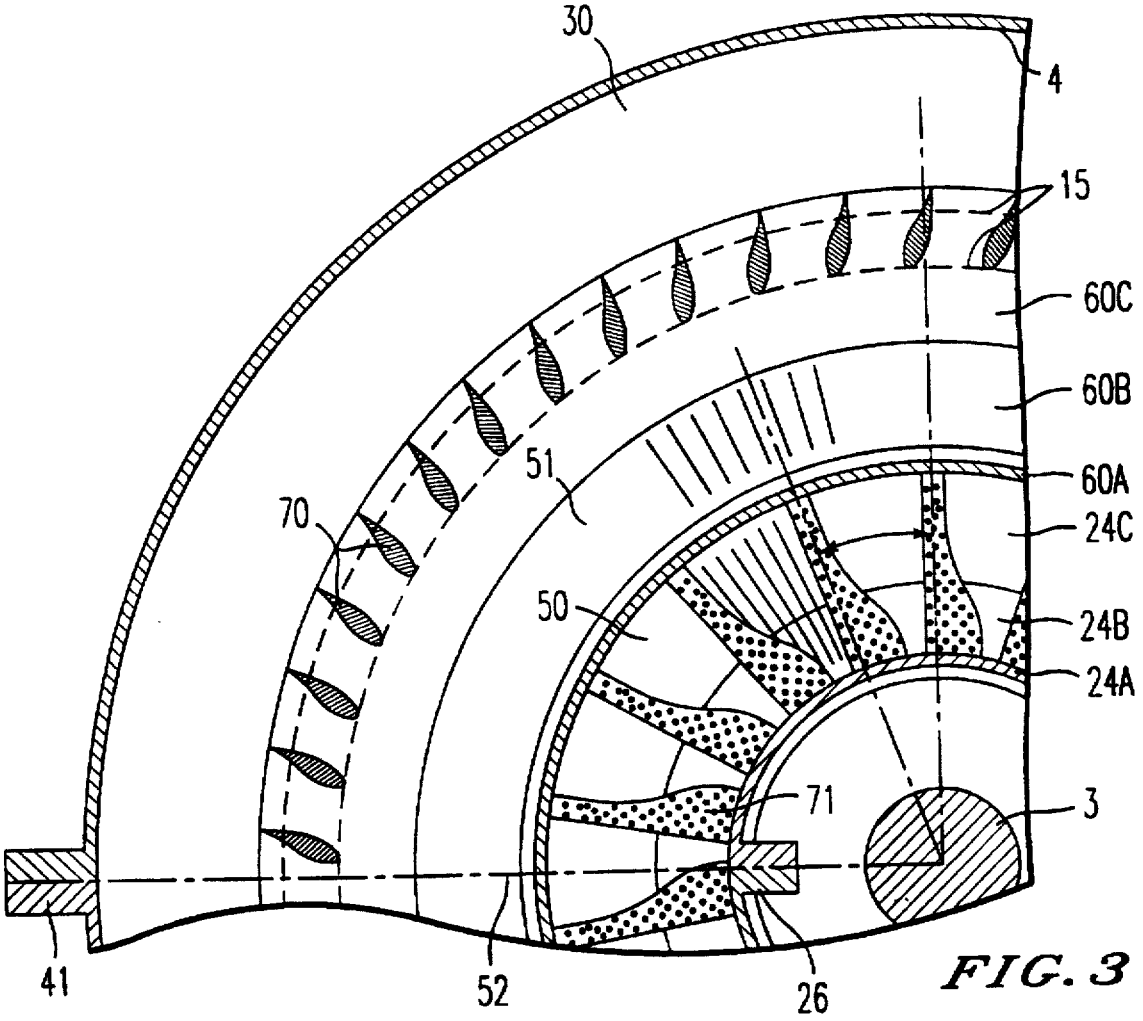
FIG. 3 shows a part cross section through the diffusor along the sectional line 3—3 in FIG. 2.

Referring now to the drawings, wherein like reference numerals designate identical or corresponding parts throughout the several views and the direction of flow of the working medium is designated by arrows, in FIG. 1 in the steam turbine, with an axial/radial exhaust steam diffusor, only the elements essential for understanding the mode of operation bear reference symbols. The main components are the outer housing 1, the inner housing 2 and the rotor 3. The outer housing consists of a plurality of parts, not designated in further detail, which are usually screwed or welded to one another at the place of installation. The inner housing consists of the inflow housing 4 in the form of a torus and of the downstream guide-blade carriers 5 which are equipped with the guide blades 6. The outer housing, inner housing and blade carriers are divided horizontally and are screwed to one another at separating flanges 41 (FIG. 3). The inner housing is supported in the outer housing by means of supporting arms in the plane of these separating flanges.

The rotor 3 equipped with the moving blades 7 is welded together from shaft disks and shaft ends by means of integrated coupling flanges. It is supported in bearing housings by means of sliding bearings, not shown.

The path of the steam leads from a feed-steam conduit via the steam lead-thru in the outer housing 1 into a flow channel the inner housing 2. The torus ensures that the steam, guided with precision, arrives at the blading. After the energy of the steam has been transmitted to the rotor 3, the steam passes via an annular diffusor 11 to the exhaust-steam space 30 of the outer housing 1 before it flows off downwards (in the drawing) to the condenser. Axial-flow shaft seals 13 at the rotor lead-thru in the outer housing prevent air from entering the exhaust steam. In this known machine, it is evident from the shape of the diffusor that the bending-angle idea is not implemented. At the diffusor inlet, the opening angle of the blading is greatly reduced. For the merely local assistance of the deflection, there can be seen two axially staggered guide plates which have to be fastened to the diffusor inner walls and diffusor outer walls by means of the above-mentioned disadvantageous struts.

Figure 2:
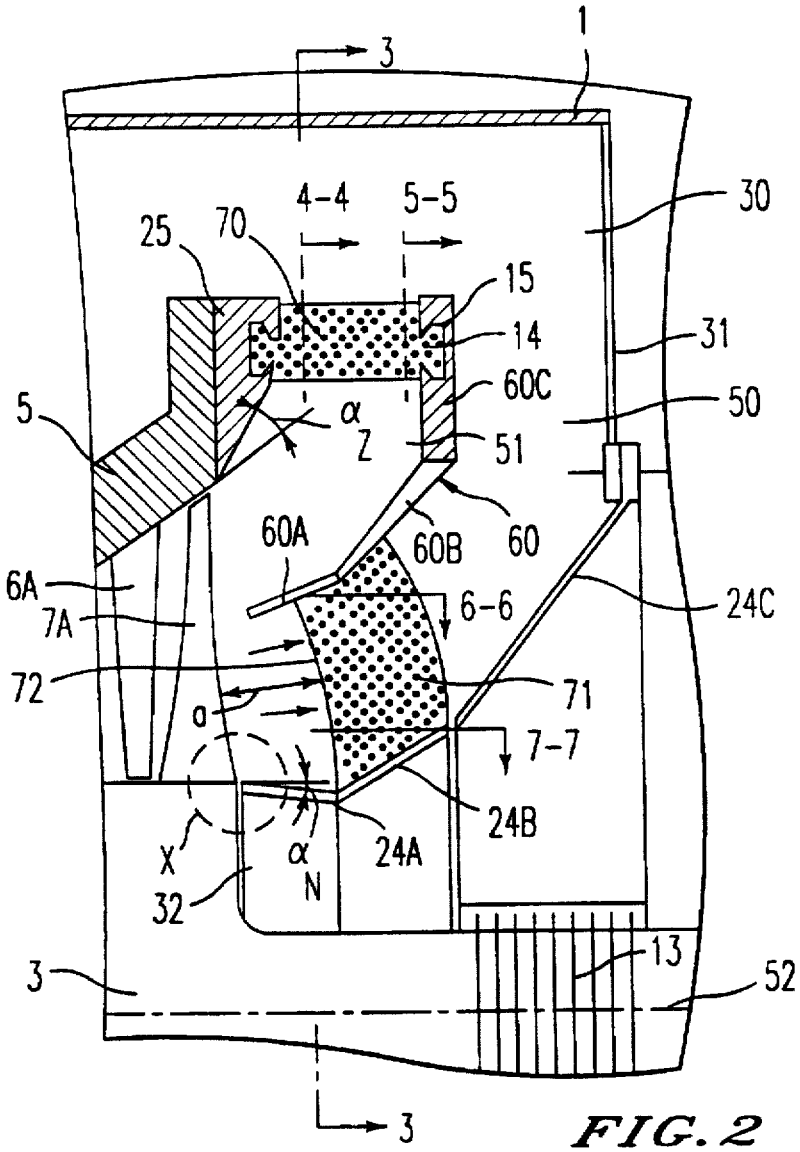
FIG. 2 shows a part longitudinal section through a diffusor according to the invention.
Figure 4:
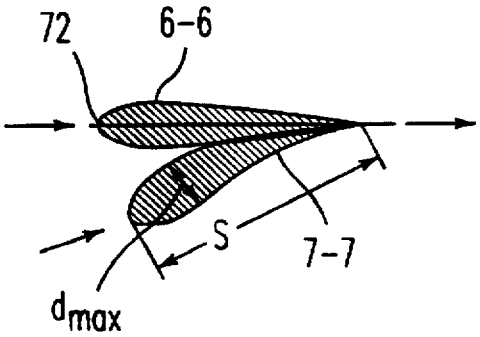
FIG. 4 shows a part cross section through the flow ribs along the sectional lines 6—6 and 7—7 in FIG. 2.
Figure 5:
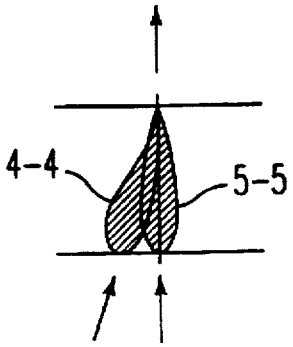
FIG. 5 shows a part cross section through the flow ribs along the sectional lines 4—4 and 5—5 in FIG. 2.

In FIGS. 2 and 3, functionally identical elements bear the same reference symbols as in FIG. 1. Of the blading, only the last stage at the downstream end of the flow channel and in the form of a guide-blade row having the guide blades 6A and the moving-blade row having the end blades 7A are shown.

The flow-limiting outer walls of the diffusor channel are formed by the diffusor outer ring 25 and the diffusor inner ring 24. The former is screwed to the blade carrier 5 (as indicated) downstream of the radially outer wall of the flow channel. The latter is located downstream of the radially inner wall of the flow channel and is of a multi-part design. Nearest to the blading, a ring part 24A extends at least approximately in the axial direction. This is followed by a deflecting ring part 24B which merges into a ring part 24C deflecting to an even greater extent. The parts 24A and 24B are welded to one another. An axial gap is provided between the parts 24B and 24C. The housing of the shaft seal 13 is fastened to the ring part 24C. Downstream, the ring part 24C is connected via a flange to the rearward baffle wall 31 extending essentially vertically. The baffle wall is itself connected in a steam-tight manner to the outer housing 1.

The diffusor channel is subdivided by means of a deflecting guide plate 60 into two part channels, an inner channel 50 and an outer channel 51. For production reasons, this guide plate is likewise designed in three parts: a first part 60A, a highly deflecting middle part 60B and a vertically extending part 60C. The three parts are welded together to form a unitary whole.

The surface area ratios of the two part channels 50, 51 are determined by taking into account the total pressure profile or the flow energies downstream of the last moving blade 7A. A higher surface area ratio (i.e., one having a greater surface area for the outer channel) is selected when, for example, high kinetic energies have to be converted, which primarily occurs in the outer channel; correspondingly, a smaller surface area is selected for the inner channel when lower energies are to be converted there. In the present case, the same surface areas are provided for the outer channel 50 and inner channel 51 from the diffusor inlet to the diffusor outlet. The various angles of incidence for the guide-plate part 60B and the diffusor inner ring 24B, 24C are consequently given. The guide-plate part 60A is set so that the flow reaches it without a jolt. Of course, in contrast to the embodiment shown, the diffusor inner ring 24 and the guide plate 60 can also be designed with a continuous curvature.

The kink angle of the two limiting walls 24 and 25 of the diffusor at their upstream ends, i.e., their angles with respect to the fluid flow channel and directly at the outlet of the blading, is critical for the desired mode of operation of the diffusor. The blading is a highly loaded reaction blading with a large opening angle. The flow passes through the last moving-blade row 7A with a high Mach number. The channel contour of the blade foot is cylindrical and that at the blade tip extends obliquely at an angle of up to 40°. If this conicity were continued in the diffusor, said angle of 40° would be completely unsuitable for decelerating the flow and achieving the desired pressure rise; the flow would break away from the walls. Purely constructive considerations would usually lead to a reduction in the diffusor angle from 40° to approximately 7°. However, the deflection of the flow lines brought about thereby at the kink points of the diffusor inlet and the associated harmful pressure build-up meanwhile reduces the gradient, i.e., the steam work across the blading. The result of this is lower power. The energy not utilized leads to locally excess velocities at the diffusor outlet and is consequently dissipated in the exhaust-steam housing.

The diffusor is therefore designed solely from the point of view of fluid mechanics. The considerations must lead to as homogeneous a total pressure profile as possible over the entire flow channel height. The two kink angles are therefore determined on the basis of the total flow in the blading and in the diffusor.

The equation for radial equilibrium teaches that the meridian curvature of the flow lines is primarily responsible for the extent of the above-mentioned pressure increase. This must therefore be influenced primarily by an adaptation of the kink angle, in order to achieve a homogeneous total-pressure distribution. The (second) kink angle $\alpha_N$ (FIGS. 2 and 6) of the inner limiting wall 24 at the diffusor inlet is fixed in principle by this consideration. In the present case, this leads to an angle $\alpha_N$ which decreases from the horizontal in the negative direction, specifically by about 10°.

It can be seen from this that an arbitrary, for example cylindrical, shape of the inner limiting wall of the diffusor would at all events be unsuitable for compensating the typical flow-off defects. However, by means of the new measure, excess energy is reduced by increasing the shaft work. It would otherwise be dissipated as residual energy downstream of the diffusor.

Figure 6:
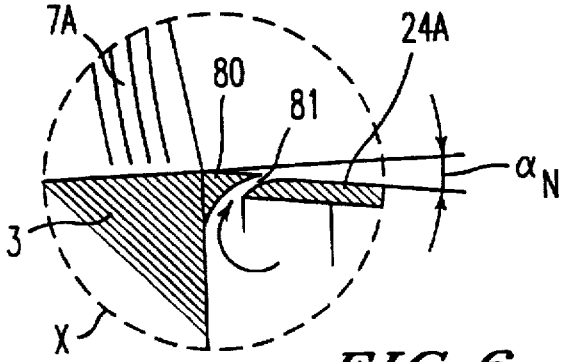
FIG. 6 shows the detail X of FIG. 2 on an enlarged scale.

In the example shown according to FIG. 6, the formation of the kink angle $\alpha_N$ at the hub takes place by means of a collar 80 arranged on the rotor 3 in a suitable way. The collar extends over the portion of the axial length of the diffusor inner ring 24A which receives the flow first. An obliquely extending annular channel 81 is formed between the collar end and the diffusor inner ring 24A. For this purpose, the collar underside and the front edge of the diffusor inner ring 24A are shaped correspondingly. This measure has the advantage of shielding the flow-off in the blade foot region against harmful cross-flow effects. In conventional machines, cross flows of this kind are driven by the pumping effect of the rotor side wall 32, the barrier steam and the rotational asymmetry of the outer housing 1.

The same considerations are now also to be made with regard to the (first) kink angle $\alpha_Z$ at the cylinder, that is to say at the outer limiting wall 25. It is appropriate to remember here, however, that the flow is of very high energy as a result of the gap stream between the blade tip and blade carrier 2. Moreover, it has a pronounced co-rotation. A homogeneous energy distribution can be achieved here only when the kink angle $\alpha_Z$ at the cylinder at all events opens outward relative to the inclinations of the blading channel. In the particular example, this takes place through an additional 10°–15°.

As a result, the total opening angle of the diffusor is markedly larger than the opening angle of the blading. However, it does not under any circumstances assume a value which would correspond to purely constructive considerations. The conditions are thereby afforded for the pressure conversion to take place in the downstream diffusor in such a way that a homogeneous, non-rotational flow-off occurs at the outlet of the latter.

It is clear, however, that a diffusor with a total opening angle of approximately 60° is unsuitable for decelerating the flow. As regards the known diffusor initially mentioned, therefore, the channel is subdivided in the radial direction by means of flow-guiding guide rings into a plurality of part diffusors which are dimensioned according to the known rules for a straight diffusor.

In the present case, the single guide plate 60, already described, subdivides the channel through which the flow passes into two part diffusors. The flow-guiding parts of this diffusion zone are shown in FIG. 2. The two part diffusors are designed as bell diffusors (bell-shaped diffusor). This means that the equivalent opening angle $\Theta$ of the meridian contours downstream of the bending angles $\alpha_Z$ and $\alpha_N$, determined according to the above criteria, is reduced in order to avoid a flow breakaway. This takes place first to a greater extent and subsequently to a lesser extent, thus leading to a shape equivalent to the bell shape. By an equivalent opening angle Θ is meant here:

$$\tan \theta/2 = \frac{1}{U}, \frac{da}{ds},$$

in which

U=the local extent of the flow cross section dA=the local change in the flow cross section;

ds=the local change in the flow path along the part diffusor.

According to the invention, radial-flow outer flow ribs 70 are now arranged in the outer channel 51 of the diffusor and diagonal-flow inner flow ribs 71 in the inner channel 50.

FIG. 2 shows that the inner flow ribs 71 are connected to the diffusor inner ring 24B and to the guide-plate parts 60A and 60B, for example by welding. It is also shown that the radial-flow flow ribs 70 are fastened in the outer channel 51. A fastening means suitable for absorbing both tensile forces and compressive forces is shown. Provided here on the two ends of the outer flow ribs are respective identical foot plates 14 which are guided in corresponding turned recesses of the diffusor outer ring 25 and of the vertically extending part 60C of the guide plate, in a hammerhead or dovetail manner known, per se. For this purpose, the arcuate circumferential surfaces of both the inner and the outer plate sides are provided with grooves into which correspondingly dimensioned prongs of the foot plates 15 engage.

The system consisting of the guide plate 60A–60C together with the inner and outer flow ribs 71, 70 and the associated inner (24A, 24B) and outer (25) diffusor rings thus forms a self-supporting unit. For reasons of assembly, these units are designed as half-shells with a horizontal parting plane. These half-shells are screwed to one another at the parting plane via inner flanges 26 (FIG. 3). The parting plane 26 intersects the machine axis. The lower half-shell (not shown) can be fastened to the housing of the shaft seal 13.

This design makes access to the blading easier. If, for example, an end blade 7A is to be removed, the following procedure is adopted: first, the exhaust-steam cowl (part of the outer housing 1), together with the upper housing of the shaft seal 13, is lifted off. Thereafter, after the release of the flange screws of the diffusor inner ring and the screw connection of the diffusor outer ring, the upper half-shell of the self-supporting constructional unit can be lifted off as a whole.

It goes without saying that a diffusor insert of this type is preeminently suitable for the retrofitting of existing plants. In order, in such a case, to design the necessary diffusor geometry, by which is to be meant the kink angles, the surface ratios of the part channels and the geometry of the flow ribs, with pinpoint accuracy, a prior measurement of the flow directly downstream of the last moving-blade row 7A is recommended. The necessary diffusor geometry is then determined according to inverse design principles. In the case of plants to be newly designed, the diffusor insert should be designed on the basis of the guarantee points or the critical operating range.

The number of radial-flow outer flow ribs 70 amounts to fifty (50) in the present case. The advantage of this even number is, according to FIG. 3, that there are no ribs in the horizontal parting plane. The large number of flow ribs 70 is also advantageous, inter alia, because a small radial overall height or a minor influence on the constructional space for the diffusor and exhaust steam are thereby achieved.

In the present instance, the number of inner flow ribs 71 amounts to eighteen (18). As shown in FIG. 3, with this even number there are no ribs in the horizontal parting plane. This number and the fluidic design of the ribs 70, 71 are based on the following considerations:

In the first place, the distance "a" between the front edge 72 of the inner flow ribs 71 and the outlet of the blading is determined so as to achieve a desired ratio with the rib spacing "t" which is a measure of the number of ribs. If this ratio (a/t) amounts to at least 0.5, interference with the last moving-blade row 7A of the blading can be largely avoided.

In the present instance, two factors are to be taken into account in the determination of the chord length of the flow ribs. The flow ribs have a supporting function, and it is therefore necessary not to fall short of a minimum cross section. With regards to the deflection function of the flow rib, by means of which the rotational flow is to be straightened, it is likewise necessary not to fall short of a minimum chord length. If the ratio of the rib chord "s" to the rib spacing "t" (s/t) is at least 1 and the ratio, to be described later, of the largest profile thickness $d_{max}$ of the flow ribs to the rib chord "s" ($d_{max}/s$) is approximately 0.15, then both functions can be performed.

The arrangement of the flow ribs is subject to the following criteria: in order to allow access to the blading, the diffusion zone is provided with a horizontal parting plane, that is to say the diffusor inner ring, diffusor outer ring and guide plate are of divided design.

Preferably no flow ribs are placed in this horizontal parting plane, in order to avoid a division of the ribs. On the other hand, it is appropriate to arrange flow ribs in the vertical plane. The number of ribs most suitable for present purposes is 18.

The ratio of the largest profile thickness "$d_{max}$" of the flow ribs to the rib chord "s" is to amount to at most 0.15 and is kept largely constant over the rib height. These ribs, which are relatively thin in contrast to the flow ribs in the diffusor initially mentioned, avoid local Mach-number problems and minimize varying displacement effects over the rib height.

Again in contrast to the flow ribs in the diffusor initially mentioned, the flow ribs are of curved design. The curvature of the median line of the ribs is selected with a view to a jolt-free inlet and an axial flow-off, thus leading to a usually variable curvature overt he rib height.

The diagonal-flow inner ribs 71 can have a basic conicity. This is based on the idea of a ratio of chord to spacing (s/t) adapted to the deflection function. This configuration constitutes the initial position which is subsequently adapted in steps over the rib height to the actual flow. For this purpose, the front edges 72 of the ribs are oriented over the rib height in such a way that they are intersected perpendicularly by the flow lines. This leads to front edges which in no way have to be oriented radially or axially.

The invention also makes it possible to allow some counter-rotation at the outlet from the last moving blades 7A, since an axial orientation takes place by means of the flow ribs downstream in the diffusor. This counter-rotation affords the following advantages:

1. The stage work can be increased, with the efficiency remaining constant, or the efficiency can be increased, with the stage work remaining constant;
2. The blades of the last moving-blade row can be designed with less distortion, thus leading to lower cost;
3. The deflection in the last turbine guide-blade row can be reduced, this being particularly important in wet-steam turbines on account of the particle separation.

In conclusion, it can be seen that the new diffusor insert has a high efficiency potential such that coefficients of pressure recovery of up to 60% are possible. The kink angle idea, together with the flow-oriented ribs for the low-loss conversion of the rotational energy into pressure energy; and the non-rotational flow-off of the two rib rows, ensures a minimum of residual energy. Moreover, the existing symmetrical flow spaces in the exhaust steam, primarily in the parting plane, are utilized in the best possible way in respect of the lowest possible velocity level. As regards the configuration shown, it is to be noted that the inner channel 50 is required only partially for the actual diffusion process. The downstream part in the region of the baffle wall 31 increases the free cross section in the parting plane and thus serves for reducing the harmful rotational asymmetry.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An axial-flow turbo-machine having a fluid flow channel containing a plurality of rows of rotor blades past which a fluid may flow in a substantially axial flow direction to produce a fluid flow having a rotational flow component at a downstream end of said plurality of rotor blades in the flow direction, said channel having a channel height at a downstream-most row of said rotor blades in the flow direction, which comprises;

a radially outer diffusor ring having an upstream end forming a first kink angle with a radially outer wall of said fluid flow channel;

a radially inner diffusor ring having an upstream end forming a second kink angle with a radially inner wall of said fluid flow channel, a diffusor channel being defined between said inner and outer diffusor rings, wherein said first and second kink angles are selected such that a total pressure profile over said channel height is substantially equalized, the diffusor including a collar extending from the radially inner wall of said fluid flow channel and towards said upstream end of said radially inner diffuser ring, said collar forming an annular flow channel extending obliquely to the flow direction such that a barrier fluid flow is into the fluid flow from said rotor blades.

* * * * *